US007121420B2

(12) United States Patent
Baudin

(10) Patent No.: US 7,121,420 B2
(45) Date of Patent: Oct. 17, 2006

(54) CONTAINER WITH REMOVABLE PROTECTIVE ELEMENT

(75) Inventor: Gilles Baudin, Domont (FR)

(73) Assignee: L'Oreal, (FR)

( * ) Notice: Subject to any disclaimer, the term of this patent is extended or adjusted under 35 U.S.C. 154(b) by 68 days.

(21) Appl. No.: 10/648,568

(22) Filed: Aug. 25, 2003

(65) Prior Publication Data

US 2004/0069677 A1 Apr. 15, 2004

Related U.S. Application Data

(60) Provisional application No. 60/408,282, filed on Sep. 6, 2002.

(30) Foreign Application Priority Data

Aug. 23, 2002 (FR) ..... 02 10541

(51) Int. Cl.
*B65D 51/18* (2006.01)
*B65D 51/16* (2006.01)

(52) U.S. Cl. ..... 220/256.1; 220/366.1

(58) Field of Classification Search ..... 220/256.1, 220/203.6, 202, 791, 793, 805, 359.2, 361, 220/366.1, 667.1, 592.01–592.28, 232–234, 220/271; 206/581, 823, 204; 215/292–298, 215/320

See application file for complete search history.

(56) References Cited

U.S. PATENT DOCUMENTS 2,358,270 A 9/1944 Wild
3,445,050 A 5/1969 Friehe et al.
3,613,938 A 10/1971 Westcott
4,058,214 A 11/1977 Mancuso
4,162,010 A 7/1979 Hovsepian
4,413,748 A * 11/1983 Kessler et al. ..... 220/281
5,509,564 A * 4/1996 Knoop ..... 220/360
5,613,618 A * 3/1997 Raoult ..... 220/369
5,829,608 A * 11/1998 Clerget ..... 215/44
6,053,183 A * 4/2000 Rizzo ..... 132/307

* cited by examiner

*Primary Examiner*—Lien M. Ngo
(74) *Attorney, Agent, or Firm*—Lerner, David, Littenberg, Krumholz & Mentlik, LLP

(57) ABSTRACT

A container including a container body having an interior edge delimiting an aperture. The container further including a protective element for sealing the interior of the container body. The protective element includes an inner surface, an outer surface and a peripheral edge adapted to be supported on the edge of the container body to form a seal between the container body and protective element. The protective element also includes a gripping element located on the outer surface of the protective element and positioned along a first axis. The container further includes At least one interrupted area and at least one rib for facilitating the breaking of the seal formed between the container body and the protective element to allow separation of the protective element from the container body.

16 Claims, 2 Drawing Sheets

Fig. 2
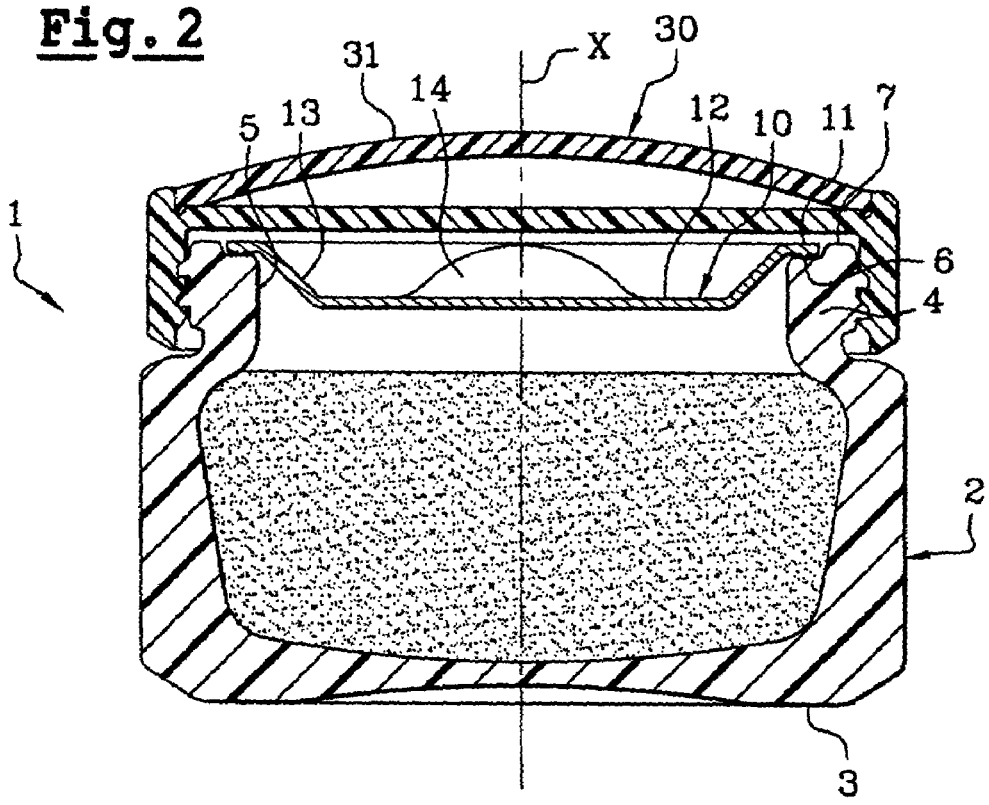
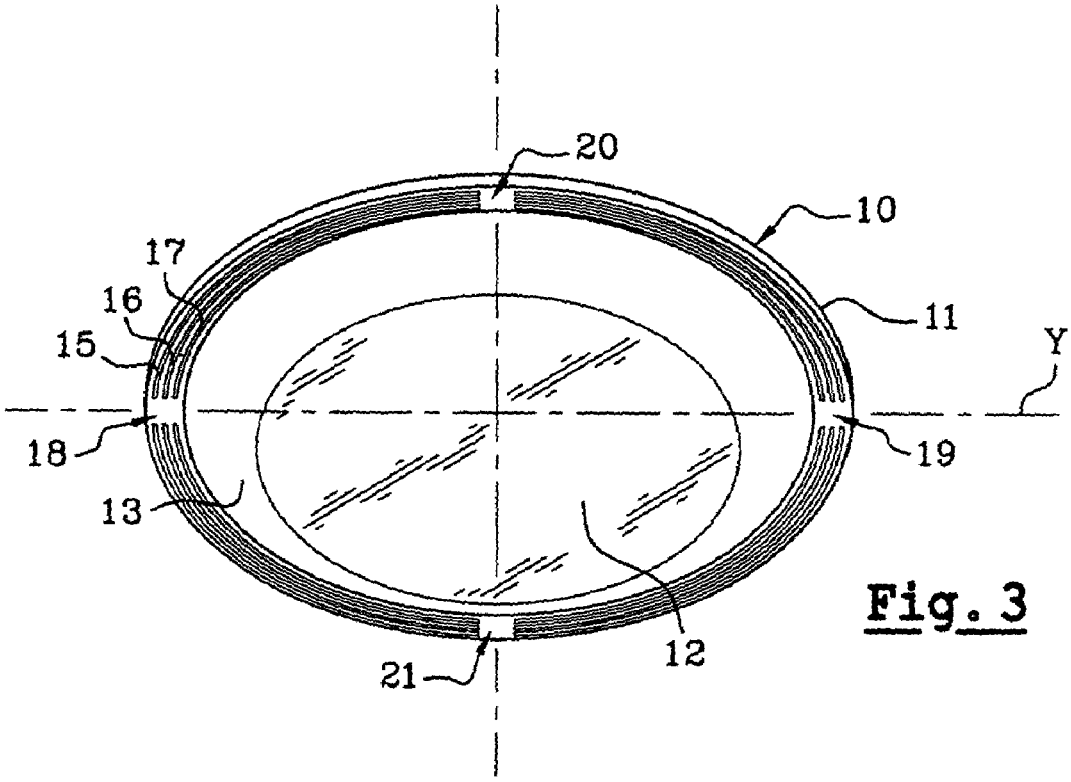
Fig. 3

CONTAINER WITH REMOVABLE PROTECTIVE ELEMENT

CROSS-REFERENCE TO RELATED APPLICATIONS

The present application claims the benefit of U.S. Provisional Application No. 60/408,282, filed on Sep. 6, 2002, the disclosure of which is incorporated by reference herein.

BACKGROUND OF THE INVENTION

The present invention relates to a container for the packaging of a product, in particular of a cosmetic product. The container according to the invention more particularly is in the form of a glass pot for the packaging of a cosmetic product, in particular a skin care cream.

Pots of cosmetic cream are often sold to consumers with a protective element, sometimes known as an "inner seal". The inner seal, generally is fairly flexible, and may be supported at its periphery by the edge of the aperture of the pot. The inner seal may further be held in place by means of a screw-on lid. The inner seal protects the lid from the cream and prevents the latter from soiling the lid.

Generally the inner seal comprises a flexible tab which facilitates its removal, and which, more particularly, helps to overcome the suction cup effect inevitably generated by the inner seal in contact with the cream.

The handling of a flexible inner seal of this kind, in particular at increased speeds poses problems especially on an industrial production line.

It is one of the objects of the present invention to produce a container, in particular in the form of a pot, which is provided with a protective element in the form of an inner seal and which totally or partly overcomes the problems discussed above with reference to the known systems of prior art.

It is in particular an object of the present invention to produce such a container, which is economic to make and handle, in particular on an industrial production line. Additionally, the container should be simple to use, in particular when first opened.

Other objects will become apparent in the detailed description which follows.

SUMMARY OF THE INVENTION

According to the present invention these objects are achieved by producing a container having an edge delimiting an aperture and a rigid protective element arranged in a removable manner supported on the edge. The protective element may have a gripping element centered on an outer surface of the protective element. The gripping element being of elongated form along a Y axis. The protective element may include a tearing element essentially arranged along the Y axis and/or an axis perpendicular to the Y axis. At a time of movement of the protective element intended to separate it from the edge, the tearing element suitable for forming a tear to break the seal facilitates removal of the protective element.

"Rigid" is preferably understood to mean "which does not crush easily." That is to say "which either breaks or is deformed or damaged in an irreversible manner", when attempt is made to fold it. Thus, if the lid is made from plastic, stress aimed at folding or deforming it causes degradation, which can particularly result in the material whitening.

Advantageously, the protective element may be configured in the form of a cup. A raised peripheral edge may be included with the protective element, which is supported on the edge of the container.

Preferably the tearing element is arranged in the vicinity of the peripheral edge of the protective element, along the Y axis, on two sides of the gripping element.

Thus assuming movement of the protective element along the Y axis, in order to remove it, the area of the protective element which first loses contact with the edge of the container is located on the periphery of the protective element. Essentially this is along the Y axis, on the side of the gripping element situated opposite the arm of the operator. The tearing element is located essentially at the same location. As a result as soon as movement of the protective element is started, air is drawn inside the container, thus causing pressure equilibrium between the container and the outside. This avoids, if not reduces, the suction cup effect mentioned above.

As previously mentioned, advantageously the tearing element is arranged in the vicinity of the peripheral edge of the protective element. Further, it may be located along an axis perpendicular to the Y axis, on both sides of the gripping element.

Thus assuming movement of the protective element along a direction perpendicular to the Y axis, the area of the protective element which first loses contact with the edge of the container, is located on the periphery of the protective element. Its location is further defined in that it is at 90° relative to the Y axis, on the side of the gripping element situated opposite the arm of the operator. The tearing element is also located at this location. As a result, as soon as the movement of the protective element is started, air is drawn inside the container. This causes pressure equilibrium between the container and the outside, thus avoiding or at least reducing the suction cup effect mentioned above.

According to a specific embodiment of the present invention, the protective element may include, in the vicinity of the periphery of the protective element's internal surface, at least one annular rib. The rib is intended to be supported on the edge. The tearing element also may include at least one area interrupted by the annular rib.

Additionally, the protective element may include a plurality of annular, concentric ribs.

The protective element is preferably made by molding a thermoplastic material, in particular polypropylene or polyethylene.

The container can be configured in the form of a pot, in particular a glass pot. The container may also be provided with a means of closure, in particular in the form of a screw-on lid. The lid is intended to seal the aperture. Advantageously when the closure means are in the fitted position on the container, the closure means may axially immobilize the protective element.

The container according to the invention can be used advantageously for packaging a cosmetic product, in particular, a skin care cream.

The invention, apart from the arrangements detailed above, consists of a certain number of other arrangements which will be clarified below, on the basis of non-limitative embodiments described with reference to the appended figures, wherein

BRIEF DESCRIPTION OF THE DRAWINGS

FIG. 2 is a cross-sectional view of the container in FIG. 1; and

FIG. 3 is a bottom view of the lower part of the protective element used in the container shown in FIGS. 1 and 2.

DETAILED DESCRIPTION

Figure 1:
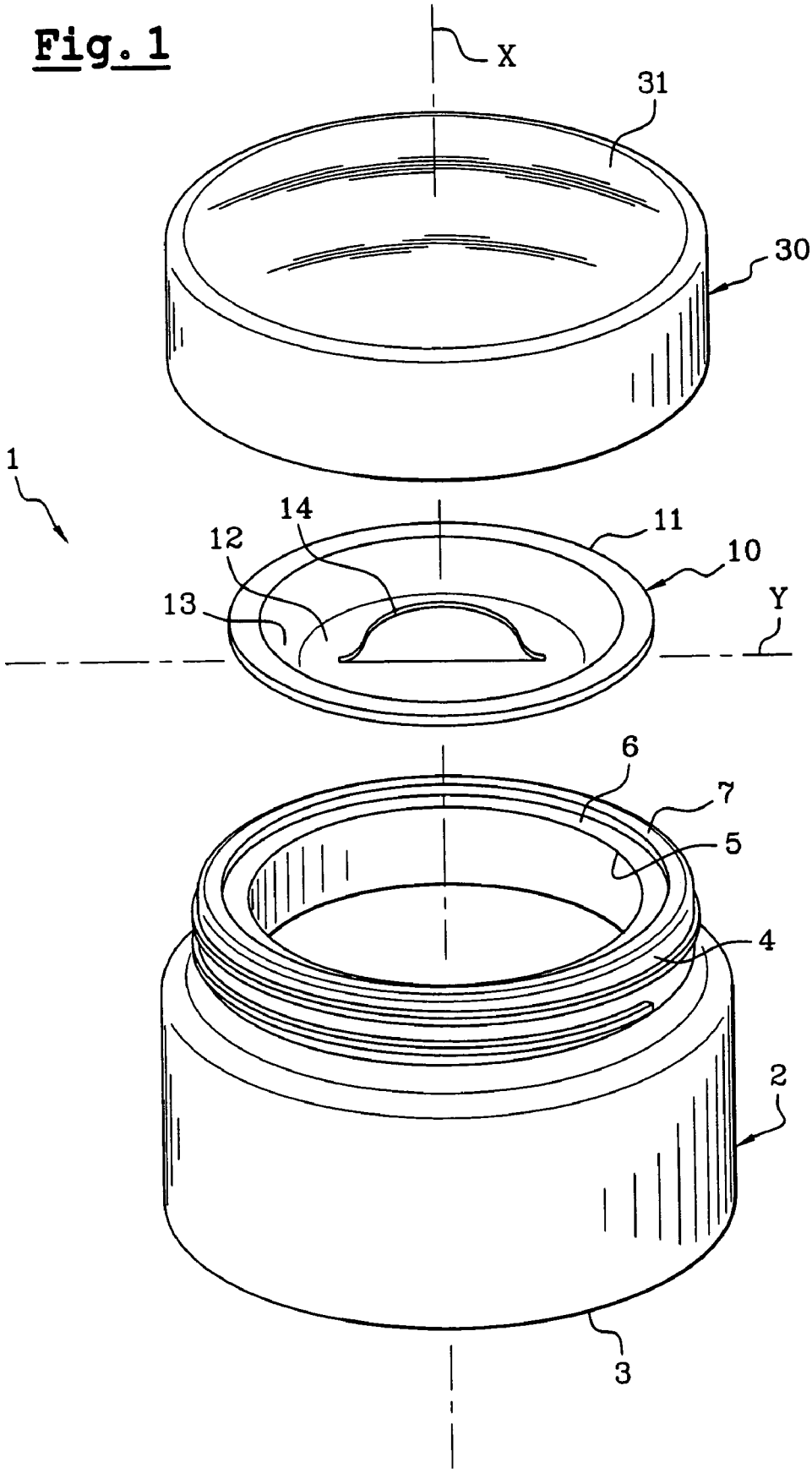
FIG. 1 is an exploded view of a container according to a preferred embodiment of the present invention.

Container 1 represented in FIGS. 1 and 2 includes a glass pot 2, having an X axis and circular section. The pot 2 may be glass.

One end of the pot 2 is closed by a base 3. Opposite the base 3, the pot 2 forms a neck 4, the external surface of which may be threaded.

The free edge of neck 4 defines an aperture 5. An internal annular area 6 of the free edge is essentially flat. Its height is slightly lower than the height of the external annular area 7 of the free edge. The difference in height corresponds essentially to the thickness of the inner seal, which will be discussed in more detail below.

The internal annular area 6 is intended to receive the peripheral edge 11 of inner seal 10.

The inner seal 10 may be configured in the form of a rigid cup. Preferably, the inner seal 10 is made from a high density polypropylene or polyethylene material. A central area 12 of the inner seal 10 is essentially flat and is joined to the peripheral edge 11 by an inclined area 13.

Essentially, in its center as may be defined by central area 12 of the inner seal 10, the inner seal 10 includes on its outer surface, inside the pot 2, a tab 14. Tab 14 may be configured in the shape of a portion of a disk in elongated form along a Y axis. However, tab 14 may be located along various other axes located on central area 12.

The height of the tab 14 in a preferred embodiment is such that its highest point is essentially equal to the height of the peripheral edge 11 of the inner seal 10. However, the maximum height of tab 14 may be less.

As shown in FIG. 3, on the side of the inner seal 10 opposite the tab 14, the peripheral edge 11 may include a plurality of annular concentric ribs 15, 16, 17, as for example. In a preferred embodiment, ribs 15, 16, and 17 may be interrupted in a plurality of areas. For example, four areas 18, 19, 20, 21, may be spaced at 90° from one another in a preferred embodiment. Two of the areas 18, 19 may be essentially along the Y axis. The other two 20, 21 may be along an axis perpendicular to the Y axis.

The angular width of each sector 18–21 is in the order of one to several degrees.

Container 1 may also include a screw-on lid 30. The threaded internal surface of lid 30 is suitable for cooperating with threads located on neck 4. The uppermost part of lid 30 consists of a convex wall 31, which can be snap-fastened onto lid 30.

Contact between tab 14 and the internal surface of lid 30 can contribute to the immobilization of the inner seal 10 located at the edge of the pot 2. This provides the required seal. Alternatively the internal surface of lid 30 may comprise an annular rib (not shown). When lid 30 is in the closed position, the annular rib is intended to be supported on the peripheral edge 11 of the inner seal 10, so as to immobilize the latter and make a seal.

When using the container 1, in particular for the first time, the consumer removes lid 30. The consumer then grips the inner seal 10 by the tab 14. Next, the consumer impresses on the inner seal 10 a movement aimed at its removal with an upward motion, a force component of which is along the Y axis. In this case the area of the inner seal 10, which first loses contact with the internal area 6 of the edge of the container, is the interrupted area 18 or 19. Due to the presence of an interrupted area at this point, as soon as movement of the inner seal 10 is started, air is drawn inside pot 2, thus causing pressure equilibrium between the container 1 and the outside. This avoids or at least reduces the generation of a suction cup effect.

Conversely, if the consumer impresses on it a movement aimed at its removal with an upward motion, a component of which is perpendicular to the Y axis, then the area of the inner seal 10, which first loses contact with the internal area 6 of the edge of the container, is the interrupted area 20 or 21. Due to the presence of an interrupted area at this location, as soon as the movement of the inner seal 10 is started, air is drawn inside pot 2, thus causing pressure equilibrium between the container 1 and the outside. Thus, once again avoiding or at least reducing the generation of a suction cup effect.

After initial use, before replacing lid 30, the consumer can choose to replace (or not replace) the inner seal 10.

In the example described above, reference has been made to preferred embodiments of the present invention. It is obvious that alternatives may be included in these without departing from the spirit of the invention as claimed below.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed:

1. A container comprising:

a container body having an outwardly facing rim delimiting an aperture and an inwardly facing wall partially defining said aperture; and a protective element having a perimeter, a first side and a second side, said first side having at least one rib extending about said perimeter and at least one interrupted area disposed at said perimeter of said protective element, at least a portion of said at least one interrupted area confronting said outwardly facing rim of said container body, and said at least one rib abutting said outwardly facing rim, said protective element further including a gripping element located on said second side and aligned with said at least one interrupted area, wherein said protective element is adapted to separate from said container body at a location corresponding to said at least one interrupted area in response to an upward force to said gripping element.

2. A container according to claim 1, wherein said protective element is configured in the form of a cup, said perimeter including a raised peripheral edge, said raised peripheral edge being supported on said outwardly facing rim of said container body.

3. A container according to claim 2, wherein said gripping element has at least two sides and said first side of said protective element has at least two interrupted areas, said gripping element having a proximal end and a distal end arranged along a Y axis, wherein said proximal and distal ends are aligned with said at least two interrupted areas.

4. A container according to claim 1, wherein said perimeter of said protective element includes a peripheral edge supported on said outwardly facing rim of said container body and said first side has at least two interrupted areas, said gripping element has at least two sides, and wherein said sides of said gripping element are arranged in the vicinity of said peripheral edge of said protective element and aligned with said at least two interrupted areas.

5. A container according to claim 3, wherein said first side has two additional interrupted areas which are proximal and distal ends arranged along an axis traverse to said Y axis on said two sides of said gripping element.

6. A container according to claim 4, wherein said first side has two additional interrupted areas which are arranged along an axis perpendicular to said Y axis on said proximal and distal ends of said gripping element.

7. A container according to claim 1, wherein said first side of said protective element includes a plurality of said ribs.

8. A container according to claim 2, wherein said first side of said protective element includes a plurality of said ribs.

9. A container according to claim 3, wherein said first side of said protective element includes a plurality of said ribs.

10. A container according to claim 4, wherein said first side of said protective element includes a plurality of said ribs.

11. A container according to claim 5, wherein said protective element comprises a plurality of annular, concentric ribs.

12. A container according to claim 1, wherein said protective element includes a molded thermoplastic material.

13. A container according to claim 1, said container body is configured in the form of a pot.

14. A container according to claim 1, wherein said container includes a recess adapted for receiving product, further comprising a lid intended to overlay said recess of said container body.

15. A container according to claim 14, wherein said lid has a fitted position on said container body such that when said lid is in said fitted position, said lid axially immobilizes said protective element relative to said container.

16. A container according to claim 1, wherein said container is used for packaging a cosmetic product.

* * * * *